US010136738B2

(12) United States Patent
Xu

(10) Patent No.: US 10,136,738 B2
(45) Date of Patent: Nov. 27, 2018

(54) HOOK-ON CHAIR

(71) Applicant: Dongguan Master Kids Products Co., Ltd., Guangdong (CN)

(72) Inventor: Jiahong Xu, Guangdong (CN)

( * ) Notice: Subject to any disclaimer, the term of this patent is extended or adjusted under 35 U.S.C. 154(b) by 0 days.

(21) Appl. No.: 15/429,183

(22) Filed: Feb. 10, 2017

(65) Prior Publication Data

US 2018/0140110 A1 May 24, 2018

(30) Foreign Application Priority Data

Nov. 18, 2016 (CN) ..... 2016 1 1015256

(51) Int. Cl.
*A47D 1/10* (2006.01)

(52) U.S. Cl.
CPC ..... *A47D 1/106* (2013.01)

(58) Field of Classification Search
CPC ..... A47D 1/106
USPC ..... 297/174 CS
See application file for complete search history.

(56) References Cited

U.S. PATENT DOCUMENTS 4,863,216 A * 9/1989 Prescott ..... A47D 1/106 297/134
6,273,503 B1 * 8/2001 Cheng ..... A47D 1/106 297/135
6,679,549 B2 * 1/2004 Catelli ..... A47D 1/106 297/174 CS
7,845,719 B2 * 12/2010 Flannery ..... A47D 1/106 297/174 CS
8,678,491 B2 * 3/2014 Chen ..... A47D 1/106 297/134
2008/0203780 A1 * 8/2008 Anselmi ..... A47D 1/106 297/174 CS
2008/0296938 A1 * 12/2008 Flannery ..... A47D 1/106 297/174 CS
2010/0038936 A1 * 2/2010 Gibson ..... A47D 1/106 297/174 CS

* cited by examiner

*Primary Examiner* — Shin H Kim
(74) *Attorney, Agent, or Firm* — Prakash Nama; Global IP Services, PLLC

(57) ABSTRACT

The present invention discloses a hook-on chair comprising a seat, a lower clamping arm, a height adjustment mechanism and a height fine-adjustment mechanism. The seat comprises a seat body, which is provided with an upper clamping arm and a vertical support tube. The lower clamping arm is arranged on the vertical support tube and vertically moves along the same. A lower clamping unit is arranged on the front portion of the lower clamping arm and below the upper clamping arm. The height adjustment mechanism comprises an adjustment part arranged in the vertical support tube, and a first locking device used for locking the lower clamping arm on the adjustment part. The height fine-adjustment mechanism is arranged on the lower portion of the vertical support tube, and used for driving the adjustment part to vertically move in the vertical support tube and adjust the height of the lower clamping arm.

9 Claims, 7 Drawing Sheets

HOOK-ON CHAIR

BACKGROUND OF THE INVENTION

The invention relates to the technical field of dining chairs, in particular to a hook-on chair for a baby having meals.

The existing hook-on chair for a baby having meals generally comprises a seat, two upper clamping arms arranged on two sides of the seat, two lower clamping arms arranged on two sides of the seat, two vertical support rods arranged on the seat, and locking devices. The two upper clamping arms are opposite to the two lower clamping arms vertically, and the opposite surfaces of the upper clamping arms and the lower clamping arms are provided with an upper anti-slip pad and a lower anti-slip pad, respectively. The rear portion of each lower clamping arm is provided with a lifting base, which is movably sleeved with the corresponding vertical support rods and moves vertically along the vertical support rods to drive the lower clamping arm up and down. The locking devices are arranged on the lifting base. When the lower clamping arms moves up to work with the upper clamping arms along with the lifting base and clamp the tabletop in between, the locking devices are manually driven to lock the lifting base in place, so that the upper and lower clamping arms remain clamping the tabletop, and the hook-on chair is mounted in place. When the hook-on chair is to be dismounted, the locking devices should be released to unlock the lifting base.

However in the conventional hook-on chair of this type, only by adjusting the height of the lower clamping arms through the lifting base and locking with the locking devices, it is difficult for the upper and lower clamping arms to completely lock down the tabletop in between at one time by jacking up the lifting base in the process of locking. Therefore, after locking, the hook-on chair is easy to slip or shake, and clamping and security are relatively low.

BRIEF SUMMARY OF THE INVENTION

The invention aims at providing a hook-on chair to achieve better clamping with the tabletop and security of the use.

For this purpose, the present invention provides a hook-on chair, comprising:

a seat which comprises a seat body, the seat body is provided with an upper clamping arm extending forwards and a vertical support tube extending downwards;

a lower clamping arm installed on the vertical support tube and moving along the same. The front portion of the lower clamping arm is provided with a lower clamping unit below the upper clamping arm, the lower clamping arm can work with the upper clamping arm to clamp or release the tabletop between the lower clamping unit and the upper clamping arm as the lower clamping arm moves vertically along the vertical support tube.

a height adjustment mechanism comprising an adjustment part arranged on the vertical support tube and a primary locking device used for locking the lower clamping arm on the adjustment part.

a height fine-adjustment mechanism arranged on the lower portion of the vertical support tube and used for driving the adjustment part to move vertically along the vertical support tube so as to adjust the height of the lower clamping arm.

The technical scheme of the invention includes that the vertical support tube is provided with an adjustment part inside so as to position the lower clamping arm initially, the lower portion of the vertical support tube is provided with the height fine-adjustment mechanism used for driving the adjustment part to move vertically in the vertical support tube. During installation, the hook-on chair moves to the position of the tabletop between the upper clamping arm and the lower clamping arm firstly, then the lower clamping arm is driven to vertically move towards the upper clamping arm along the vertical support tube to be abutted against the upper clamping arm and the lower clamping arm, the primary locking device is driven to lock the lower clamping arm to the adjustment part, and the hook-on chair is pre-clamped. Later, the height fine-adjustment mechanism is driven to drive the adjustment part to move vertically upwards along the vertical support tube and the lower clamping arm to move up. As such, the upper clamping arm and the lower clamping arm are provided with secondary pressure to clamp the tabletop tighter, and finally clamping of the hook-on chair and the tabletop is finished. Apparently, the height of the lower clamping arm is adjusted twice with the additional height fine-adjustment mechanism, the lower clamping arm is thereby driven to work with the upper clamping arm to clamp the tabletop better, and the hook-on chair installed on the tabletop is prevented from shaking or even moving and stability in clamping and safety of the use of the hook-on chair are improved accordingly.

DETAILED DESCRIPTION OF THE INVENTION

Figure 1:
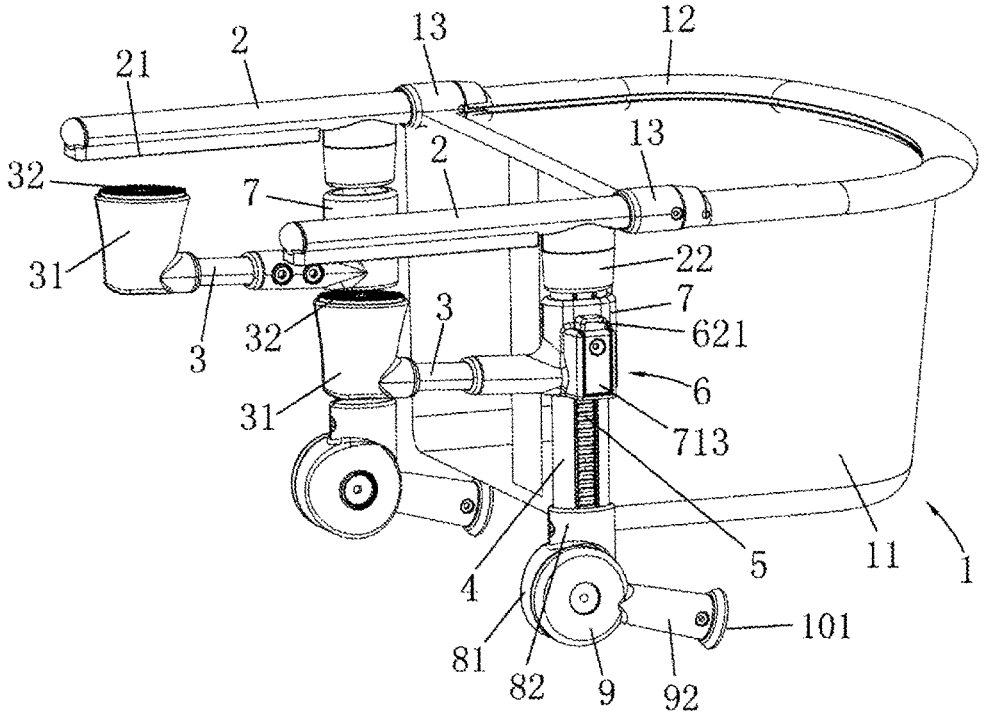
FIG. 1 is a three-dimensional schematic diagram of the hook-on chair.
Figure 2:
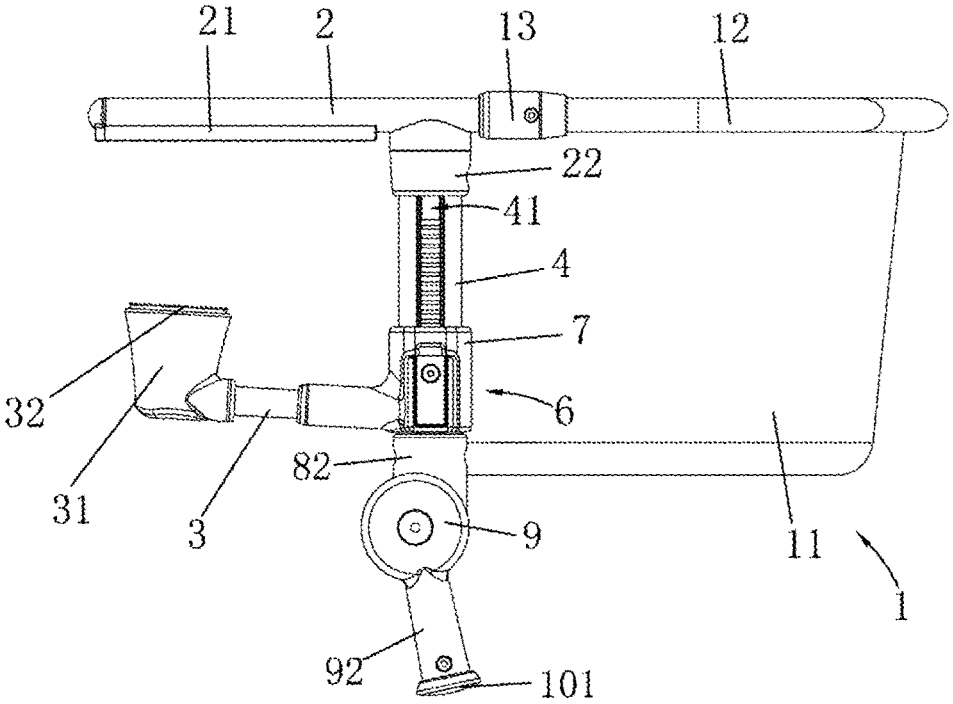
FIG. 2 is a schematic diagram of the lower clamping arm of the hook-on chair before rising.
Figure 3:
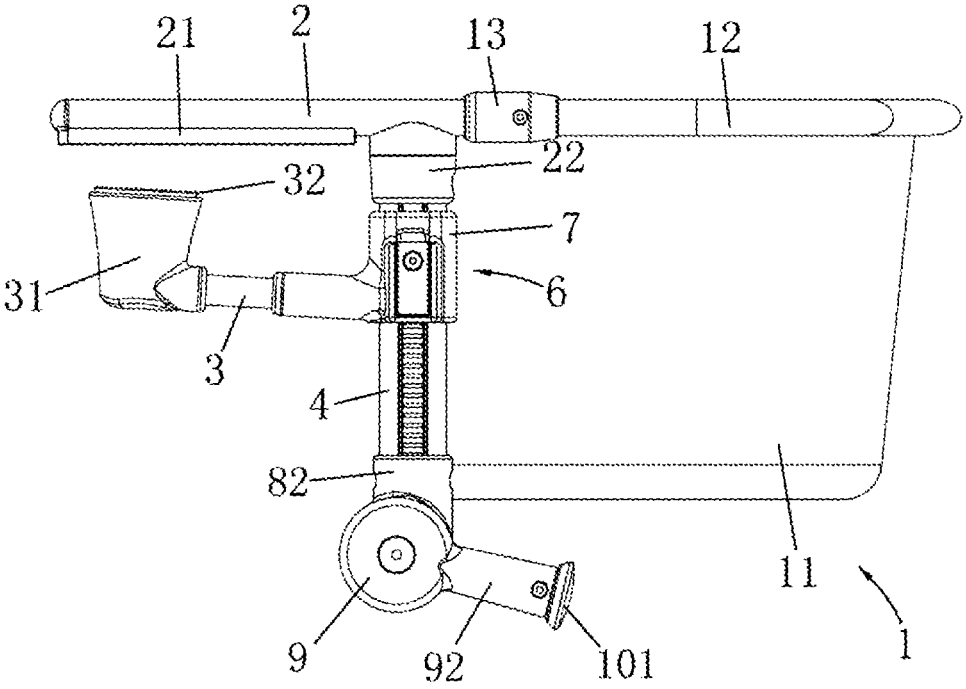
FIG. 3 is a schematic diagram of the lower clamping arm of the hook-on chair that ascends a certain height and is locked twice.

The embodiments of the invention will now be clearly and completely described, by way of example only, with reference to the accompanying drawings. Obviously, not all embodiments are described hereby.

All other embodiments obtained by those of ordinary skill in the art based on the embodiments of the present invention without creative effort are within the scope of the present invention.

It should be noted that the directive instructions involved in the embodiments of the invention (such as upper, lower, left, right, front, rear, top, bottom, inside, outside, vertical, horizontal, longitudinal, clockwise, anticlockwise, circumferential, radial and axial . . . ) only used for explaining the position relation, the moving status and more among all parts in a certain posture (as shown in figures). Once the certain posture changes, the directive instructions will change accordingly.

In addition, in the embodiments of the present invention, descriptions of "first" or "second" and the like are used for description purposes only and are not to be construed as indicative or implied its relative importance or implicitly indicating the number of technical features indicated. Thus, a feature that defines "first" and "second" may include at least one feature, either explicitly or implicitly. In addition, the technical solutions between the various embodiments may be combined with one another, but must be based on the ability of those ordinary skill in the art to realize that the combination of the technical solutions should be considered to be absent when there are contradictory or unachievable combinations of technical solutions, nor within the scope of the invention as claimed.

The present invention provides a hook-on chair.

In the embodiments of the present invention, as shown in FIG. 1 to 7, the hook-on chair comprises a seat 1, a lower clamping arm 3, a height adjustment mechanism, and a height fine-adjustment mechanism.

A seat comprises a seat body 11, and the seat body 11 is provided with an upper clamping arm 2 extending forwards and a vertical support tube 4 extending downwards. Particularly, the seat body 11 is available in the prior art and known to those skilled of the art. For example, the seat body comprises a cushion, a backrest arranged on the cushion, and a "U"-shaped protective part 12 arranged on the backrest, and the specific structure and shape will not be elaborated herein.

A lower clamping arm 3 installed on the vertical support tube 4 and moving along the same 4. The front portion of the lower clamping arm 3 is provided with a lower clamping unit 31 below the upper clamping arm 2, the lower clamping arm 3 can work with the upper clamping arm 2 to clamp or release the tabletop (not shown) between the lower clamping unit 31 and the upper clamping arm 2 as the lower clamping arm 3 moves vertically along the vertical support tube 4;

a height adjustment mechanism comprises an adjustment part 5 arranged on the vertical support tube 4 and a primary locking device 6 used for locking the lower clamping arm 3 on the adjustment part 5. Particularly, the adjustment part 5 is shaped like rods. When the adjustment part 5 and the lower clamping arm 3 are unlocked, the lower clamping arm 3 can move vertically relative to the adjustment part 5 along the vertical support tube, while the primary locking device 6 locks the lower clamping arm 3 on the adjustment part 5, and the lower clamping arm 3 and the adjustment part 5 can move vertically along the vertical support tube 4 together.

The height fine-adjustment mechanism is arranged on the lower portion of the vertical support tube 4 and used for driving the adjustment part 5 to move vertically along the vertical support tube 4 so as to adjust the height of the lower clamping arm 3 locked on the adjustment part 5 as well as the vertical distance between the upper clamping arm 2 and the lower clamping arm 3. Optionally, there could be two lower clamping arms 3, two upper clamping arms 2, two vertical support tubes 4, two height adjustment mechanisms and two height fine-adjustment mechanisms, arranged on two sides of the seat body, respectively. It should be noted that without affecting use, they could be one or more than three.

During installation, the hook-on chair moves to the position of the tabletop between the upper clamping arm 2 and the lower clamping arm 3 (see FIG. 2) firstly, then the lower clamping arm 3 is driven to vertically move along the vertical support tube 4 towards the upper clamping arm to be abutted against the upper clamping arm 2 and the lower clamping arm 3, the primary locking device 6 is driven to lock the lower clamping arm 3 to the adjustment part 5, and the hook-on chair is pre-clamped. Later, the height fine-adjustment mechanism is driven to drive the adjustment part 5 to move vertically upwards along the vertical support tube 4 and the lower clamping arm 3 to move up. As such, the upper clamping arm 2 and the lower clamping arm 3 are provided with secondary pressure to clamp the tabletop tighter (see FIG. 3), and finally clamping of the hook-on chair and the tabletop is finished. Apparently, the height of the lower clamping arm 3 is adjusted twice with the additional height fine-adjustment mechanism, the lower clamping arm 3 is thereby driven to work with the upper clamping arm 2 to clamp the tabletop better, and the hook-on chair installed on the tabletop is prevented from shaking or even moving and stability in clamping and safety of the use of the hook-on chair are improved accordingly.

Figure 4:
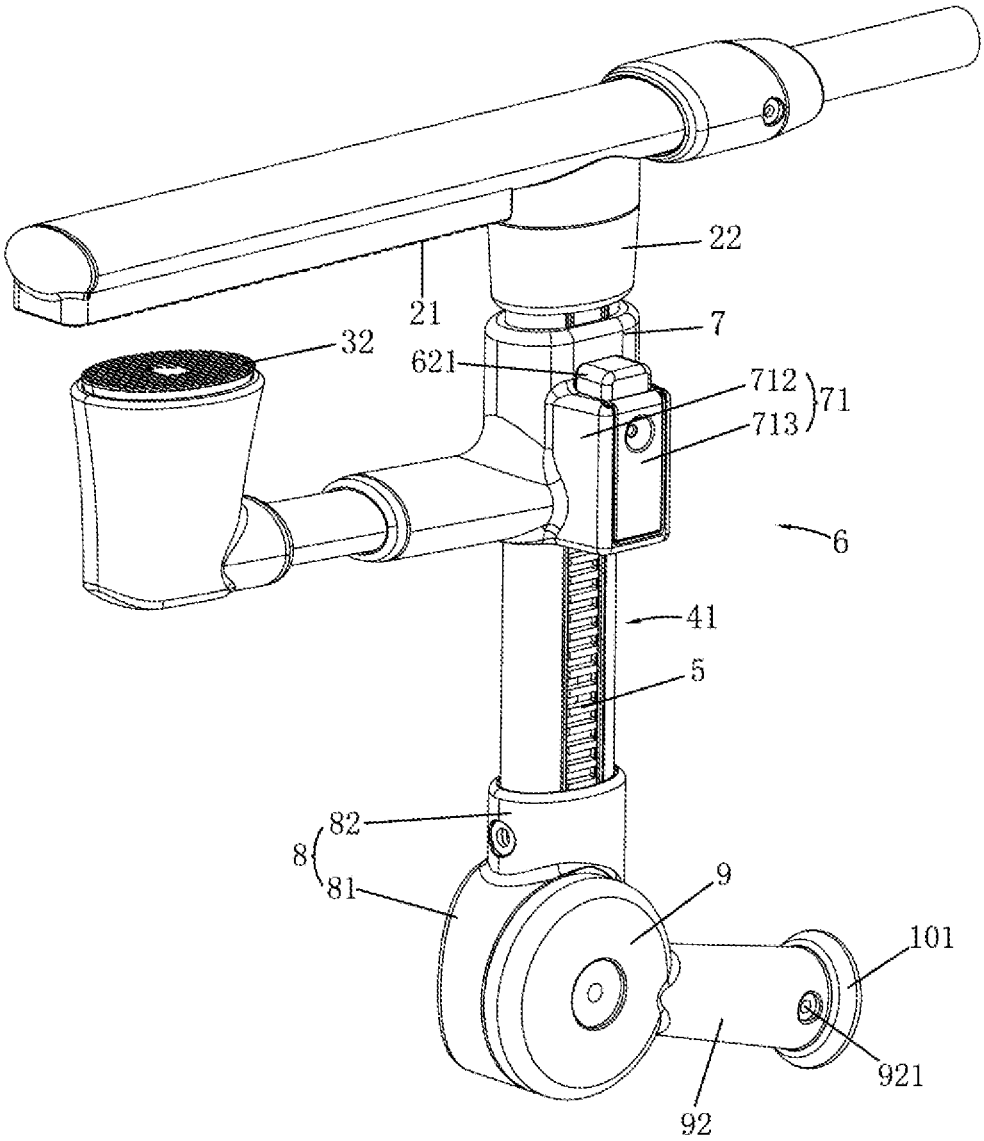
FIG. 4 is a schematic diagram of the lower clamping arm, the upper clamping arm, the height adjustment mechanism and the height fine-adjustment mechanism of the hook-on chair that are coordinated.

In the embodiments of the present invention, as shown in FIG. 1 and FIG. 4, the rear portion of the lower clamping arm 3 is provided with a lifting base 7, which is movably sleeved with the vertical support tube 4 and can move along the vertical support tube 4. Particularly, the lifting base 7 and the lower clamping arm 3 can be of split structure. The rear portion of the lower clamping arm 3 is connected with the lifting base 7, for example, can be fixedly connected by welding (for a metal material) or by a detachable structure such as the screw structure or the fastening structure, or by inserting into the insert holes and fastening. Taking convenience in molding and cost reduction into consideration, the lifting base 7 and the lower clamping arm 3 can be integrally molded.

Figure 5:
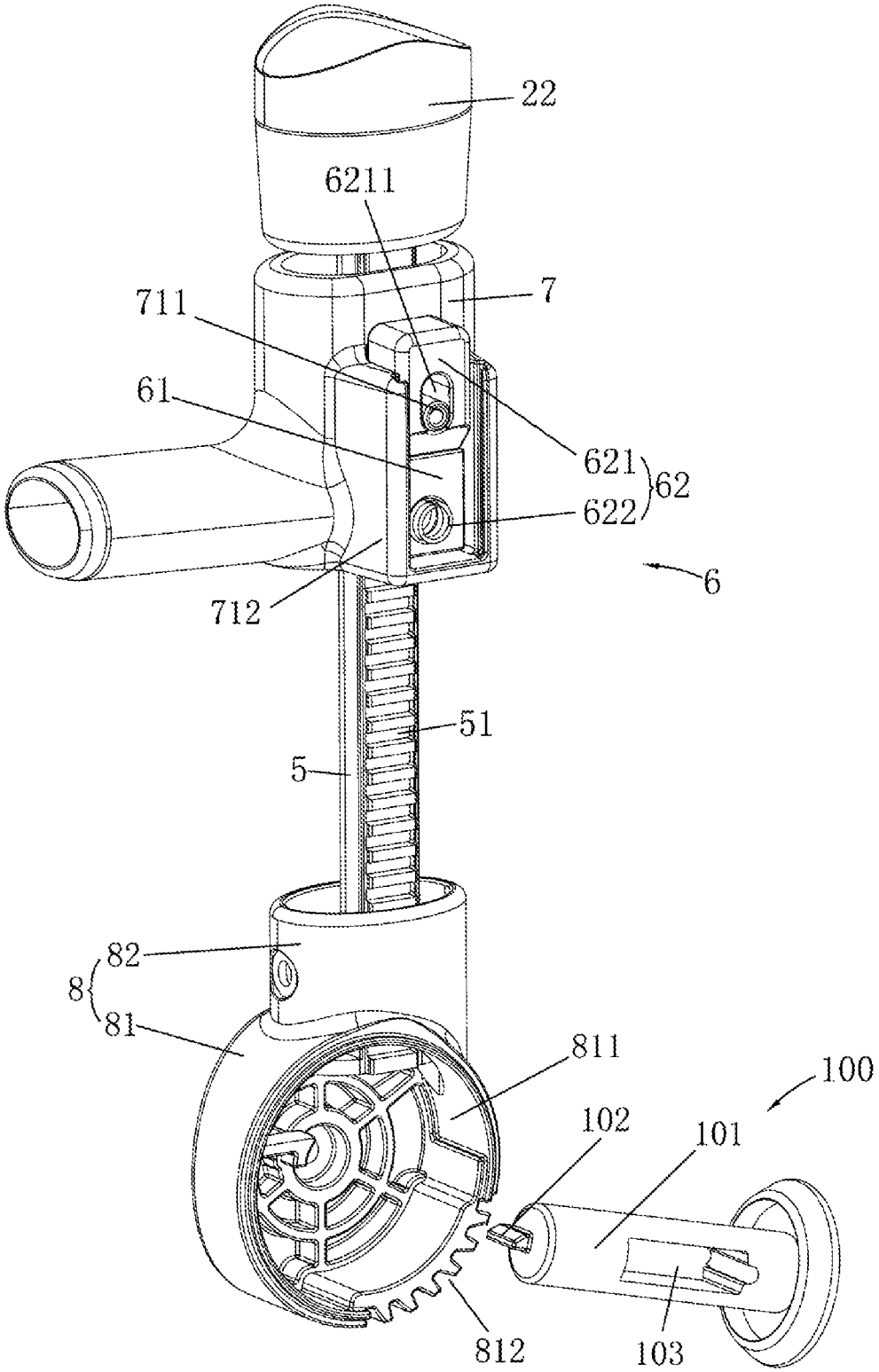
FIG. 5 is a local schematic diagram of the lower clamping arm, the upper clamping arm, the height adjustment mechanism and the height fine-adjustment mechanism of the hook-on chair that are coordinated.
Figure 6:
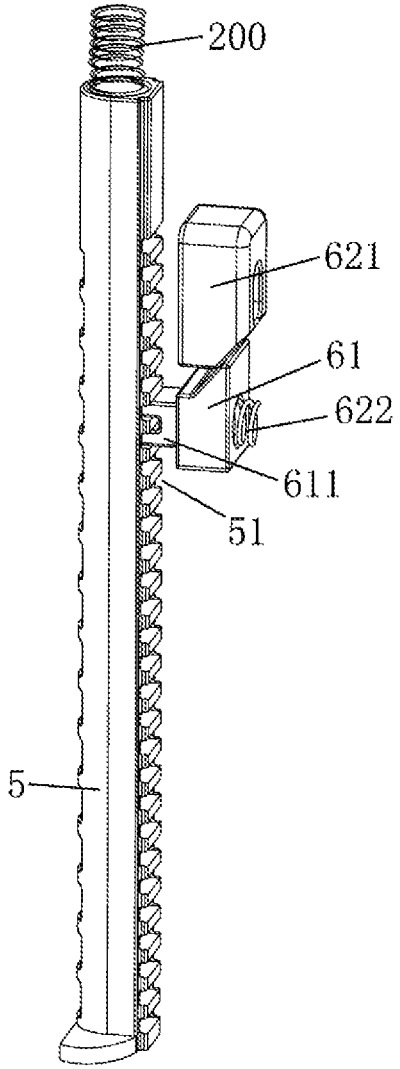
FIG. 6 is a schematic diagram of the adjustment part, the primary locking device and the reset spring that are coordinated.
Figure 7:
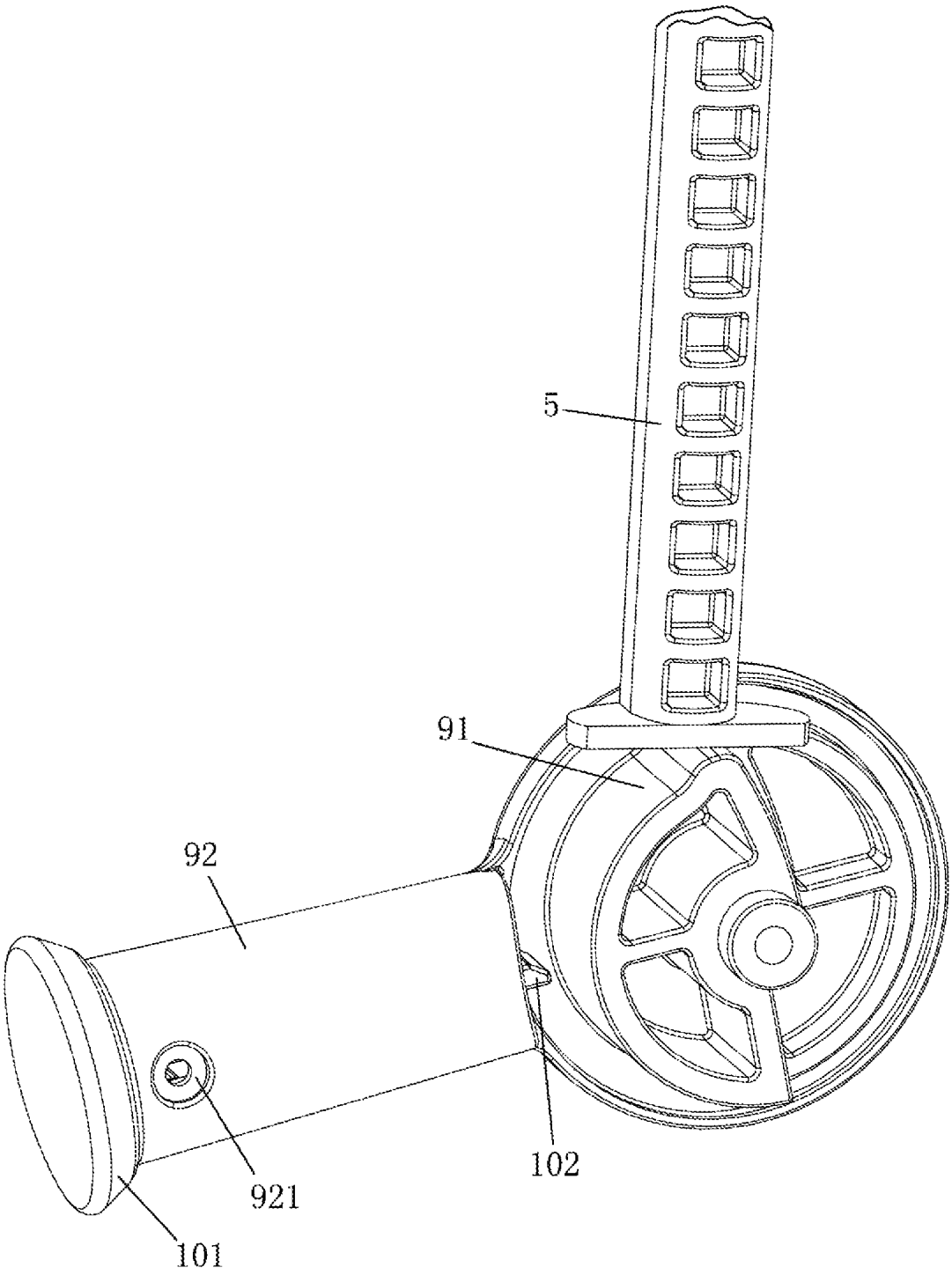
FIG. 7 is a schematic diagram of the adjustment part, the second driving component that are coordinated.

In one of the embodiments of the invention, as shown in FIG. 4 to 6, the primary locking device 6 comprises a clamping part 61 arranged on the lifting base 7 and a driving assembly 62 used for driving the clamping part 61 to move between the positions distant from and close to the adjustment part 5 horizontally. The clamping part 61 is provided with a fixture block 611 extending towards the adjustment part 5, one side of the adjustment part 5 facing the fixture block 611 is provided with a plurality of first grooves 51 matched with the fixture block 611 vertically, the vertical support tube 4 is provided with guide grooves 41 allowing the fixture block 611 to extend in and be fastened in the first grooves 51, and after the fixture block 611 is fastened into one of the first grooves 51, the lifting base 7 is locked on the adjustment part 5.

Particularly, as shown in FIG. 4 to 6, the outer sidewall of the lifting base 7 is provided with a mounting base 71, in which an accommodation cavity is formed hollowly. The upper or lower wall of the accommodation cavity is provided with a vertical via hole, the sidewall of the accommodation cavity close to the first grooves 51 is provided with a horizontal via hole (not shown) opposite to the first grooves 51, the clamping part 61 is arranged in the accommodation cavity, and the fixture block 611 can penetrate the horizontal via hole and the guide groove 41 to be snapped in the first grooves 51. The driving assembly 62 comprises a first driving component 621 and a resetting elastic component 622 arranged in the accommodation cavity, the first driving component 621 is adjacent to the clamping part 61 vertically, one side of the first driving component 621 extends out of the mounting base 71 through the vertical via hole, and the other side of the first driving component 621 and/or one side of the clamping part 61 opposite to the first driving component 621 are wedge-shaped in such a way that the other side of the first driving component 621 can be inserted between the sidewall of the accommodation cavity close to the first grooves 51 and the clamping part 61 and can drive the clamping part 61 to move in the direction away from the first grooves 51 as one side of the first driving component 621 is pressed to drive the first driving component 621 to move towards the middle of the clamping part 61. The resetting elastic component 622 can apply elastic force that drives the clamping part 61 to move towards the first grooves 51 and the fixture block 611 into the first grooves 51. In this way, simple operation and good locking effect are realized.

It should be understood that the resetting elastic component 622 is a spring arranged between the clamping part and the sidewall of the accommodation cavity distant from the adjustment part 5. After the pressure on one side of the first driving component is removed, the resetting elastic component 622 can push the clamping part 62 to drive the fixture block 611 to extend into the vertical support tube 4 and be snapped into the first grooves 51. A horizontal guide column 711 is arranged on the inner wall of the accommodation cavity, the first driving component 621 is provided with a vertical slide groove 6211 sleeved with the horizontal guide column 711 so as to guide and limit vertical movement of the first driving component 621. It should be noted that the horizontal via hole (not shown) can guide movement of the clamping part 61 except penetrates the fixture block 611.

Particularly, the mounting base 71 comprises a cover plate 713 and a shell 712 fixed or integrally formed on the outer sidewall of the lifting base 7. The upper or lower wall of the shell 712 is provided with a vertical via hole, one side of the shell 712 distant from the adjustment part 5 is provided with an opening, the cover plate 713 is detachably mounted on the shell 712 and used for sealing the opening, and an accommodation cavity is enclosed and formed by the cover plate 713 and the shell 712. It should be understood that one side of the opening extends into the vertical vie hole, the two opposite sides of the opening are provided with slots penetrating the vertical via hole, and two sides of the cover plate 713 are fastened in the slots. In this way, the cover plate 713 can be conveniently mounted and dismounted on the shell 712, and mounting the clamping part 61, the resetting elastic component 622 and the first driving component 621 and others is facilitated. Further, the horizontal guide column 711 is provided with a screw hole, the cover plate 713 is provided with a screw via hole, a screw (not shown) is mounted in the screw via hole, the screw rod penetrates the screw via hole to be screwed with the screw hole, the cover plate 713 is detachably connected with the shell 712 so as to prevent the cover plate 713 from falling.

Besides the aforementioned embodiments, other embodiments are also available for the primary locking device. For example, the primary locking device comprises a first screw (not shown), the lifting base 7 is provided with a first screw hole (not shown) penetrating its sidewall, a first screw is mounted in the first screw hole, one side of the adjustment part 5 facing the first screw hole is provided with a plurality of first grooves 51 vertically, and the vertical support tube 4 is provided with a guide groove 41 allowing the screw rod to extend in. After the rod of the first screw is screwed into the first grooves 51, the lifting base 7 is locked on the adjustment part 5. When the lifting base 7 and the adjustment part 5 need to be unlocked, the first screw may be screwed anticlockwise. Operation is simple and material and processing cost of this embodiment remains low. It should be understood that the end of the first screw is conical, and the conical end makes snapping of the first screw into the first grooves 51 easier.

In one of the embodiments of the invention, as shown in FIG. 4 to 7, the height fine-adjustment mechanism comprises a groove seat 8 connected with the lower portion of the vertical support tube, a second driving component 9 pivotally connected with one side of the groove seat, and a secondary locking device 100. The groove seat 8 comprises a circular main shell 81 and a sleeve 82 arranged at the upper end of the peripheral wall of the main shell 81. The sleeve 82 is connected with the vertical support tube 4, one side of the main shell 81 facing the second driving component 9 is opened to form a cavity 811, the lower portion of the adjustment part 5 penetrates the sleeve 82 and extends into the cavity 811 of the main shell 81, the second driving component 9 is provided with a cam 91 extending into the cavity 811 and a swing handle 92 radially extending outwards, and the track surface of the cam 91 is abutted against and supports the adjustment part 5. As the swing handle 92 drives the second driving component 9 to rotate around the pivotal center, the adjustment part 5 can be driven to vertically move and eventually drive the lower clamping arm 3 to go up and down. When the adjustment part 5 lifts in place, the second driving component 9 is locked on the groove seat 8 through the secondary locking device 100. Therefore, the adjustment part 5 is positioned, and the upper clamping arm 2 and the lower clamping unit 31 can clamp the tabletop tightly finally. To adjust the height of the adjustment part 5, one only needs to unlock the groove seat 8 and the second driving component 9 through the secondary locking device 100.

Particularly, the swing handle 92 is provided with an axial via hole, the secondary locking device 100 comprises an insert rod 101 inserted into the axial via hole, and a tongue 102 arranged at the end of the insert rod, the outer wall of the groove seat 8 is circumferentially provided with a plurality of second grooves 812 corresponding to the tongue. When the tongue 102 is snapped into one of the second grooves 812, the second driving component 9 is locked to the groove seat 8 in a way that the second driving component 9 remain rotating relative to the groove seat 8 and the lower clamping arm 3 can be positioned; the insert rod 101 can be pulled up to get the tongue 102 out of the second grooves 812 to unlock. It should be understood that the end of the tongue 102 is wedge-shaped that allows the tongue 102 to be snapped into the second grooves 812.

In the above embodiment, the axial via hole is a round or square hole. The insert rod 101 is matched with the axial via hole. In a preferred embodiment, the axial via hole is a round hole, and the insert rod 101 is fittingly inserted into the axial via hole through the round rod and the round hole. A part of the insert rod 101 in the axial via hole is provided with a guide groove 103 radially penetrating the insert rod 101, the swing handle 92 is provided with a radial guide column 921 matched with the guide groove 103 and allowing the guide groove 103 to be sleeved with, the radial guide column 921 can guide the axial movement of the insert rod 101 such that the tongue 102 can be easily inserted into the second grooves 812. Particularly, the radial side of the swing handle 92 is provided with a second screw via hole, and the other radial side is provided with a threaded hole. The radial guide column 921 is a second screw with a thread at one end, and the second screw rod is connected with the threaded hole after penetrating the second screw via hole. It should be understood that in order to improve stability in connection of the tongue 102 and the second groove 812, the spring (not shown) can apply elastic force on the insert rod 101 for movement towards the second grooves 812.

Further, as shown in FIG. 4 to 6, the top of the adjustment part 5 is provided with a reset spring 200 applying downward thrust on the adjustment part 5. The lower end of the reset spring 200 is abutted against the adjustment part 5, and the upper end is abutted against the top wall of the vertical support tube 4 (given that the top of the vertical support tube 4 is sealed), or the seat body 11 (given that the top of the vertical support tube 4). After the second driving component 9 is unlocked by the secondary locking device 100, the reset spring 200 can drive the adjustment part 5 to reset vertically and go down.

Except the above embodiment, other embodiments are also available for the height fine-adjustment mechanism. For example, the height fine-adjustment mechanism can comprise a third screw (not shown), the lower portion of the inner side of the vertical support tube 4 is provided with an inner thread matched with an outer thread of the third screw, the third screw is connected with the lower portion of the support tube, the bottom end of the adjustment part 5 is abutted against the upper end of the third screw. The adjustment part 5 can be driven up and down to drive the lower clamping arm 3 up and down by screwing the third screw. In this way, material and manufacturing cost can be lowered.

In the embodiments of the invention, the opposite surfaces of the upper clamping arm 2 and the lower clamping unit 31 are provided with an upper anti-slip pad 21 and a lower anti-slip pad 32, respectively, which are made of flexible materials such as plastic or rubber. On the one hand, stability in clamping of the upper clamping arm 2 and the lower clamping unit 31 on the tabletop is improved; on the other hand, damage to the tabletop can be prevented.

In the embodiments of the invention, the rear portion of the upper clamping arm 2 is fixedly connected with a "U"-shaped protective part 12, and the upper portion of the vertical support tube 4 is fixedly connected with the upper clamping arm 2. Particularly, the "U"-shaped protective part 12 is provided with a horizontal connecting seat 13, the rear portion of the upper clamping arm 2 is inserted into the horizontal connecting seat 13 and can be detachably fastened with the horizontal connecting seat 13 through the screw structure. The horizontal connecting seat 13 is detachably connected with the "U"-shaped protective part 12 through the screw structure or can be integrally molded with the "U"-shaped protective part 12. The upper portion of the vertical support tube 4 is connected with the upper clamping arm 2. Particularly, the vertical support tube 4 can be connected with the upper clamping arm 2 by welding (as the vertical support tube 4 and the upper clamping arm 2 are metal-based), or by the screw structure or the buckle structure, or integrally formed. The joint of the vertical support tube 4 and the upper clamping arm 2 is provided with a sheath 22. The sheath 22 serves to protect and improve appearance. The upper end of the reset spring 200 is abutted against the top wall of the vertical support tube 4 (given that the top of the vertical support tube is sealed) or the upper clamping arm 2.

The foregoing description is merely a preferred embodiment of the present invention and is not to be taken as limiting the scope of the invention. Structural transformation equivalence made on the basis of the specifications and accompanied drawings, or direct/indirect application in other related technical fields also fall within the scope of the claims of the present invention.

What is claimed is:

1. A hook-on chair, comprising:

a seat which comprises a seat body, the seat body is provided with an upper clamping arm extending forwards and a vertical support tube extending downwards;

a lower clamping arm installed on the vertical support tube and moving vertically along the same; a front portion of the lower clamping arm is provided with a lower clamping unit below the upper clamping arm, the lower clamping arm can work with the upper clamping arm to clamp or release from the tabletop between the lower clamping unit and the upper clamping arm as the lower clamping arm moves vertically along the vertical support tube;

a height adjustment mechanism comprising an adjustment part arranged on the vertical support tube and a primary locking device used for locking the lower clamping arm on the adjustment part;

a height fine-adjustment mechanism arranged on the lower portion of the vertical support tube and used for driving the adjustment part to move vertically along the vertical support tube so as to adjust the height of the lower clamping arm;

a rear portion of the lower clamping arm is provided with a lifting base movably sleeved with the vertical support tube and vertically moving along the vertical support tube; the primary locking device comprises a clamping part arranged on the lifting base and a driving assembly used for driving the clamping part to move between positions horizontally distant from and near the adjustment part; the clamping part is provided with a fixture block extending towards the adjustment part, one side of the adjustment part facing the fixture block is provided with a plurality of first grooves matched with the fixture block vertically, the vertical support tube is provided with guide grooves allowing the fixture block to extend in and be fastened in the first grooves, and after the fixture block is fastened into one of the first grooves, the lifting base is locked on the adjustment part.

2. The hook-on chair according to claim 1, wherein an outer sidewall of the lifting base is provided with a mounting base, in which an accommodation cavity is formed hollowly; an upper or lower wall of the accommodation cavity is provided with a vertical via hole, a sidewall of the accommodation cavity close to the first grooves is provided with a horizontal via hole opposite to the first grooves, the clamping part is arranged in the accommodation cavity, and the fixture block can penetrate the horizontal via hole and the guide grooves to be snapped in the first grooves; the driving assembly comprises a first driving component and a resetting elastic component arranged in the accommodation cavity, the first driving component is adjacent to the clamping part vertically, one side of the first driving component extends out of the mounting base through the vertical via hole, and the other side of the first driving component and/or one side of the clamping part opposite to the first driving component are wedge-shaped in such a way that the other side of the first driving component can be inserted between the sidewall of the accommodation cavity close to the first grooves and the clamping part and can drive the clamping part to move in the direction away from the first grooves as one side of the first driving component is pressed to drive the first driving component to move towards a middle portion of the clamping part; the resetting elastic component can apply elastic force that drives the clamping part to move towards the first grooves and the fixture block into the first grooves.

3. The hook-on chair according to claim 2, wherein the mounting base comprises a cover plate and a shell fixed or integrally formed on the outer sidewall of the lifting base; an upper or lower wall of the shell is provided with a vertical via hole, one side of the shell distant from the adjustment part is provided with an opening, the cover plate is detachably mounted on the shell and used for sealing the opening, and an accommodation cavity is enclosed and formed by the cover plate and the shell.

4. The hook-on chair according to claim 3, wherein a horizontal guide column is arranged on an inner wall of the accommodation cavity, the first driving component is provided with a vertical slide groove sleeved with the horizontal guide column so as to guide and limit vertical movement of the first driving component.

5. The hook-on chair according to claim 1, wherein opposite surfaces of the upper clamping arm and the lower clamping unit are provided with an upper anti-slip pad and a lower anti-slip pad, respectively.

6. The hook-on chair according to claim 1, wherein a top portion of the adjustment part is provided with a reset spring capable of applying thrust downwards on the adjustment part, a lower end of the reset spring is abutted against the adjustment part, and its upper end is abutted against a top wall of the vertical support tube or the seat body.

7. The hook-on chair according to claim 6, wherein the height fine-adjustment mechanism comprises a groove seat connected with the lower portion of the vertical support tube, a second driving component pivotally connected with one side of the groove seat, and a secondary locking device; the groove seat comprises a circular main shell and a sleeve arranged at an upper end of a peripheral wall of the main shell; the sleeve is connected with the vertical support tube, one side of the main shell facing the second driving component is opened to form a cavity, a lower portion of the adjustment part penetrates the sleeve and extends into the cavity of the main shell, the second driving component is provided with a cam extending into the cavity and a swing handle radially extending outwards, and a track surface of the cam is abutted against the adjustment part; as the second driving component rotates around a pivotal center, the adjustment part can be driven to vertically move; when the adjustment part lifts in place, the second driving component is locked on the groove seat through the secondary locking device.

8. The hook-on chair according to claim 7, wherein the swing handle is provided with an axial via hole, the secondary locking device comprises an insert rod inserted into the axial via hole, and a tongue arranged at an end of the insert rod, an outer wall of the groove seat is circumferentially provided with a plurality of second grooves; when the tongue is snapped into one of the second grooves, the second driving component is locked to the groove seat.

9. The hook-on chair according to claim 8, wherein the axial via hole is a round hole, and the insert rod is inserted into the axial via hole through coordination of a round rod and the round hole a part of the insert rod in the axial via hole is provided with a guide groove radially penetrating the insert rod, and the swing handle is provided with a radial column, which is fitted with the guide groove and allows the guide groove to be sleeved with it.

* * * * *